US005242487A

United States Patent [19]

Amimoto et al.

[11] Patent Number: 5,242,487

[45] Date of Patent: Sep. 7, 1993

[54] WATER- AND OIL-REPELLANT COMPOSITION

[75] Inventors: Yoshio Amimoto, Takatsuki; Takashi Enomoto; Kazunori Hayashi, both of Settsu, all of Japan

[73] Assignee: Daikin Industries Ltd., Osaka, Japan

[21] Appl. No.: 921,973

[22] Filed: Aug. 4, 1992

Related U.S. Application Data

[63] Continuation of Ser. No. 433,858, Nov. 9, 1989, abandoned.

[30] Foreign Application Priority Data

Nov. 11, 1988 [JP] Japan ..... 63-286376
Dec. 16, 1988 [JP] Japan ..... 63-319130

[51] Int. Cl.[5] ..... C09D 5/20; C09K 3/00
[52] U.S. Cl. ..... 106/2
[58] Field of Search ..... 526/245; 106/2

[56] References Cited

U.S. PATENT DOCUMENTS

| | | | |
|---|---|---|---|
| 2,737,458 | 3/1956 | Burnham | 106/2 |
| 3,462,294 | 8/1969 | Thomas | 106/2 |
| 3,549,705 | 12/1970 | Domba et al. | 106/2 |
| 3,786,089 | 1/1974 | Rondestvedt | 106/2 |
| 3,912,665 | 10/1975 | Spitzer et al. | 106/190 |
| 3,927,126 | 12/1975 | Huber-Emden | 106/2 |
| 3,940,359 | 2/1976 | Chambers | 524/430 |
| 3,960,797 | 6/1976 | Inman | 260/29.6 F |
| 4,171,415 | 10/1979 | Kleiner et al. | 427/393.4 |
| 4,219,625 | 8/1980 | Mares et al. | 427/393.4 |
| 4,472,466 | 9/1984 | Kelley et al. | 106/2 |
| 4,563,394 | 1/1986 | Ishikawa | 427/389.9 |
| 4,564,561 | 1/1986 | Lore et al. | 427/393.4 |
| 4,775,488 | 10/1988 | Hintermaier et al. | 106/2 |
| 5,143,991 | 9/1992 | Amimoto et al. | 526/245 |

FOREIGN PATENT DOCUMENTS 1222614 2/1971 United Kingdom .

OTHER PUBLICATIONS

Hawley's Condensed Chemical Dictionary, 11th Ed., Van Nostrand Reinhold Co., 1987, p. 570.

*Primary Examiner*—Mark L. Bell
*Assistant Examiner*—Alan Wright
*Attorney, Agent, or Firm*—Birch, Stewart, Kolasch & Birch

[57] ABSTRACT

A water- and oil-repellent composition which comprises a water- and oil-repellent having a fluoroalkyl group, and a glycerol compound selected from the group consisting of glycerol, an ester derivative of glycerol, an ether derivative of glycerol and polyglycerol having a melting point of lower than 70° C., imparts good water- and oil-repellency and good feeling to a fabric.

8 Claims, No Drawings

WATER- AND OIL-REPELLANT COMPOSITION

This application is a continuation of application Ser. No. 07/433,858 filed on Nov. 9, 1989, now abandoned, the entire contents of which are incorporated herein by reference.

BACKGROUND OF THE INVENTION

1. Field of the Invention

The present invention relates to an economical water- and oil-repellent composition having good water- and oil-repellency.

2. Description of the Related Arts

Water- and oil-repellents having a fluoroalkyl group are widely used and have better properties than other conventional water-and oil-repellents. However, they are relatively expensive. In order to decrease cost, it is proposed to replace a part of the water- and oil repellents having a fluoroalkyl group with a cheap acrylic acid base polymer or polyhydric alcohol such as sorbitol and lactose while maintaining water- and oil-repellency (cf. Japanese Patent Publication Nos. 22487/1963, 8579/1966 and 4160/1978). Although a reduction in costs was achieved while maintaining water- and oil-repellency, the above proposal was not satisfactory.

SUMMARY OF THE INVENTION

An object of the present invention is to provide an economical water- and oil-repellent composition having sufficient water- and oil-repellency.

This and other objects of the present invention are achieved by a water- and oil-repellent composition which comprises a water- and oil-repellent having a fluoroalkyl group, and a glycerol compound selected from the group consisting of glycerol, an ester derivative of glycerol, an ether derivative of glycerol and polyglycerol having a melting point of lower than 70° C.

DETAILED DESCRIPTION OF THE INVENTION

The ester derivative of glycerol is preferably an ester prepared by esterifying a hydroxyl group at the α-position with a monoalkane acid having 1 to 6 carbon atoms, for example, glycerol α-monoacetate, glycerol α-monoformate and glycerol α-mono-n-hexanoate. The ether derivative of glycerol is preferably an ether prepared by substituting a hydrogen of hydroxyl group at the α-position with an alkyl group having 1 to 6 carbon atoms, for example, glycerol α-monomethyl ether, glycerol α-monoethyl ether and glycerol α-monoisopropyl ether.

In a composition of the present invention, the ratio of the glycerol compound to the water- and oil-repellent is not critical and can vary in a wide range dependent on other conditions such as the kind of water- and oil-repellent and the glycerol compound. When the amount of the glycerol compound is too large, the water-and oil-repellent composition has inferior properties. When the amount of the glycerol compound is too small, the cost is not reduced and the water- and oil-repellency is not improved. Accordingly, the glycerol compound is usually used in an amount of 0.05 to 7 parts by weight, preferably 0.1 to 4 parts by weight per one part by weight of the water- and oil-repellent.

The amount of the water- and oil-repellent having the fluoroalkyl group is not limited. However, the water and oil-repellent having the fluoroalkyl group is usually used in an amount of 0.1 to 1.0 per 100 parts by weight of a medium.

The water- and oil-repellents include a homopolymer of an acrylate or methacrylate having a fluoroalkyl group having 4 to 21 carbon atoms and a copolymer thereof with a monomer having no fluoroalkyl group (cf. for example, Japanese Patent Publication 8068/1985).

Preferable acrylate and methacrylate having the fluoroalkyl groups are the following:

$$R_f(CH_2)_mOCOCR^1{=}CH_2$$

and $$R_fSO_2NR^2(CH_2)_mOCOCR^1{=}CH_2$$

wherein $R_f$ is a perfluoroalkyl group having 4 to 21 carbon atoms, $R^1$ is hydrogen or a methyl group, $R^2$ is an alkyl group having 1 to 10 carbon atoms, and m is an integer of 1 to 10.

Specific examples of such acrylates and methacrylates having a fluoroalkyl group are as follows:

$$CF_3(CF_2)_7(CH_2)_{11}OCOCH{=}CH_2$$

$$CF_3(CF_2)_4CH_2OCOC(CH_3){=}CH_2$$

$$CF_3(CF_2)_6(CH_2)_2OCOC(CH_3){=}CH_2$$

$$CF(CF_3)_2(CF_2)_6(CH_2)_3OCOCH{=}CH_2$$

$$CF(CF_3)_2(CF_2)_{10}(CH_2)_3OCOCH{=}CH_2$$

$$CF_3(CF_2)_7SO_2N(C_3H_7)(CH_2)_2OCOCH{=}CH_2$$

$$CF_3(CF_2)_7SO_2N(CH_3)(CH_2)_2OCOC(CH_3){=}CH_2$$

$$CF(CF_3)_2(CF_2)_6CH_2CH(OH)CH_2OCOCH{=}CH_2$$

$$CF(CF_3)_2(CF_2)_6CH_2CH(OCOCH_3)OCOC(CH_3){=}CH_2$$

$$CClF_2(CF_2)_{10}CH_2OCOC(CH_3){=}CH_2$$

$$H(CF_2)_{10}CH_2OCOCH{=}CH_2$$

In addition to the above, a monomer having fluoralkyl groups of the formula:

$$CF(CF_3)(CClF_2)(CF_2)_7CONHCOOCH{=}CH_2$$

can be used alone or in addition to the above methacrylates or acrylates.

Specific examples of the monomer having no fluoroalkyl group are ethylene, vinyl acetate, vinyl chloride, vinylidene chloride, acrylonitrile, styrene, α-methylstyrene, p-methylstyrene, acrylic acid and alkyl esters thereof, methacrylic acid and alkyl esters thereof, acrylamide, diacetone acrylamide, methylol diacetone acrylamide, methylol diacetone methacrylamide, vinyl alkyl ether, vinyl alkyl ketone, butadiene, isoprene, chloroprene, glycidyl acrylate, maleic anhydride and the like. The monomer having no fluoroalkyl group is usually used in an amount of 0 to 75, preferably 20 to 65 parts by weight per 100 parts by weight of the polymer.

The homo-polymers and copolymers of the above acrylates and methacrylates may be prepared by bulk polymerization, solution polymerization, emulsion polymerization and the like. Emulsion polymerization is usually preferable, and accordingly, the medium chosen usually water. The emulsion polymerization uses no specific procedure. For example, as described in Japanese Patent Publication No. 8068/1985, a mixture of monomers is emulsified in the presence of a surfactant and a polymerization initiator, and then polymerized at 50° to 100° C. with stirring. The initiator includes a peroxide, an azo compound and a persulfate. As the surfactant, any of anionic, cationic and nonionic surfactants can be used. A mixture of at least one cationic surfactant and at least one nonionic surfactant is preferable.

The composition of the present invention may include conventionally used additives, for example, a cross-linking agent, an antistatic agent, a dye fixing agent, an anticrease agent, a flame retardant, a mothproofing agent and the like, and it may include general-purpose organic solvents, for example, isopropanol and the like.

The water- and oil-repellent composition of the present invention may be applied on a material to be treated by conventionally known methods such as spraying, dipping and the like.

The materials to be treated include natural and synthetic fibers and textiles. An adsorption amount of the water- and oil-repellent to the material to be treated is preferably 0.01 to 2% by weight based on the material to be treated.

When a polyhydric alcohol, an ester or ether derivative of the polyhydric alcohol, or a polyglycerol having the melting point of not lower than 70° C. (which is not included in the glycerol compound of the present invention) is used in the water- and oil-repellent composition, some positive effects are observed but various defects also arise. For example, ester or ether derivative of a polyhydric alcohol having more carbon atoms or hydroxyl groups than glycerol remain in a treated cloth in large amounts after the water- and oil-repellency treatment, and the water- and oil-repellency property of the treatment is decreased due to the presence of hydrophilic hydroxyl groups and lipophilic alkyl groups. In addition, the treated cloth possesses a deteriorated feel. Like wise a ester or ether derivative of a polyhydric alcohol or alcohol having fewer carbon atoms or hydroxyl groups than glycerol cannot increase the water- and oil-repellency of a treated cloth. Additionally, a polyglycerol having the melting point of not lower than 70° C. has the same defects as above.

The water- and oil-repellent compositions according to the present invention is economical since the glycerol compound used as the blending component therein are more readily available than the conventional blending component which comprises a acrylic resin.

In addition, when the conventional water- and oil-repellent is added in a small amount, the water- and oil-repellency obtained is usually insufficient. However, in the present invention, the water- and oil-repellency is sufficient because of the use of the glycerol compound, even if the water- and oil-repellent adheres to a cloth small amounts.

The present invention will be illustrated by following Examples. The Examples, of course, do not restrict the present invention.

The water- and oil-repellent compositions were evaluated as follows:

Water repellency is expressed by one of the water repellency No. of Table 1 determined by the spray method according to JIS (Japanese Industrial Standard) L-1092. Oil repellency is expressed by one one the oil repellency No. of Table 2 and is determined by dropping several drops (diameter: about 4 mm) of a test solvent on two positions of a surface of a test cloth and observing whether the drops are held on the surface for 30 seconds or not. The superscript "+" to the water repellency No. represents that the result is slightly better than the recited water repellency No.

Feeling is evaluated by measuring the rigidity and softness of the cloth by the Handle-O-meter method according to JIS L-1096.

Resistance to washing is expressed by the water-and oil-repellency Nos. which are determined after carrying out five cycles each consisting of washing a cloth treated with a water and oil-repellent composition at 40° C. in water containing 0.3% by weight of detergent (Zabu-koso XK, manufactured by Kao) with a bath ratio of 1:40 (cloth:washing liquid (g:g)) for 5 minutes by using a domestic washing machine followed by rinsing the cloth for 15 minutes, dehydrating it and drying it at room temperature.

Resistance to dry cleaning is expressed by the water- and oil-repellency Nos. which are determined by washing a cloth treated with the water- and oil-repellent composition at 30° C. in tetrachloroethylene by using a Launder-O-meter followed by drying at room temperature and then measuring the water- and oil-repellency.

TABLE 1

| Water repellency No. | State |
|---|---|
| 100 | No wet on the surface |
| 90 | Slight wet on the surface |
| 80 | Drop like wet on the surface |
| 70 | Considerable wet on the surface |
| 50 | Wet over the whole surface |
| 0 | Complete wet of the surface and backface |

TABLE 2

| Oil repellency No. | Test solvent | Surface tension (dyne/cm, 25° C.) |
|---|---|---|
| 8 | n-Heptane | 20.0 |
| 7 | n-Octane | 21.3 |
| 6 | n-Decane | 23.5 |
| 5 | n-Dodecane | 25.0 |
| 4 | n-Tetradecane | 26.7 |
| 3 | n-Hexadecane | 27.3 |
| 2 | n-Hexadecane/Nujol (35/65 by weight) | 29.6 |
| 1 | Nujol | 31.2 |
| 0 | Nujol penetrated | |

EXAMPLES 1 TO 4 AND COMPARATIVE EXAMPLES 1 TO 3

A water- and oil-repellent used in a water and oil-repellent composition of the present invention was prepared as follows:

The compound (60 g) of the formula:

$$(CF_3)_2CF(CF_2CF_2)_nCH_2CH_2OOCCH{=}CH_2$$

(mixture of n=3, 4 and 5 in a weight ratio of 5:3:1), $C_{18}H_{37}OOCCH{=}CH_2$ (38 g), $CH_2{=}CHCOOCH_2CH(OH)CH_2Cl$ (2 g), pure water (250 g), acetone (50 g), n-dodecyl mercaptan (0.2 g) dimethylalkylamine acetate salt (3 g) and polyoxyethylenealkylphenol (3 g) were charged in a flask, and stirred at 60° C. for one hour under a nitrogen stream. A solution of azobisisobutylamidine hydrochloride (1 g) in water (10 g) was added and the copolymerization was carried out while stirring at 60° C. for 5 hours under the nitrogen stream. According to a gas chromatography, a conversion of copolymerization was not lower than 99%.

From this conversion, a ratio of the repeating units of the resultant copolymer was found to be substantially almost the same as a ratio of the charged monomers. The resultant emulsion contained the copolymer in a water content of 25%.

The emulsion was mixed with the blending components shown in Table 3 to prepare water- and oil-repellent compositions.

Test cloths were a polyester finished yarn woven fabric (hereinafter referred to as PE) and a nylon taffeta fabric (hereinafter referred to as N), and were dipped in the above composition for one minute and squeezed between two rolls so as to adjust the water content at 90% and 50%, respectively. Then, they were dried at 110° C. for three minutes, PE was thermally treated at 180° C. for 40 seconds and N was thermally treated at 170° C. for one minute to impart the water- and oil-repellency. The water- and oil-repellency of the treated cloths were measured. The results are shown in Table 4.

As is clear from Table 4, when the glycerol compound of the present invention is added to the water- and oil-repellent composition, good water- and oil-repellency is achieved.

TABLE 3

| Example No. | Test cloth | Adhesion of repellent to fabric (wt %) | Blending component | Adhesion of blending component to fabric (wt %) |
|---|---|---|---|---|
| 1 | PE | 0.03 | Glycerol | 0.015 |
| | N | 0.10 | | 0.05 |
| 2 | PE | 0.03 | Glycerol | 0.015 |
| | N | 0.10 | α-monomethyl ether | 0.05 |
| 3 | PE | 0.03 | Glycerol | 0.015 |
| | N | 0.10 | α-monoacetate | 0.05 |
| 4 | PE | 0.03 | Polyglycerol (melting | 0.015 |
| | N | 0.10 | point: 30° C.) (molecular weight: 170) | 0.05 |
| Comp. 1 | PE | 0.03 | — | — |
| | N | 0.10 | | — |
| Comp. 2 | PE | 0.03 | Sorbitol | 0.015 |
| | N | 0.10 | | 0.05 |
| Comp. 3 | PE | 0.03 | Polyglycerol (melting | 0.015 |
| | N | 0.10 | point: >70° C.) | 0.015 |
| | | | (molecular weight: | 0.05 |

TABLE 3-continued

| Example No. | Test cloth | Adhesion of repellent to fabric (wt %) | Blending component | Adhesion of blending component to fabric (wt %) |
|---|---|---|---|---|
| | | | 1000) | |

TABLE 4

| Example No. | Test cloth | Initial Water repellency /Oil repellency | After washing Water-repellency /Oil-repellency | After dry cleaning Water-repellency /Oil-repellency | Feeling (blank: 10 g) |
|---|---|---|---|---|---|
| 1 | PE | 100+/7 | 50/0 | 80/3 | 8 |
| | N | 100+/2 | 50/0 | 70/0 | |
| 2 | PE | 100+/7 | 50/0 | 80/3 | 8 |
| | N | 100+/1 | 50/0 | 70/0 | |
| 3 | PE | 100+/6 | 50/0 | 80/2 | 8 |
| | N | 100+/1 | 50/0 | 70/0 | |
| 4 | PE | 100+/5 | 50/0 | 80/20 | 8 |
| | N | 100/0 | 0/0 | 70/0 | |
| Comp. 1 | PE | 80+/5 | 0/0 | 70/2 | 9 |
| | N | 80/0 | 0/0 | 50/0 | |
| Comp. 2 | PE | 90/5 | 50/0 | 70+/2 | 12 |
| | N | 90/0 | 50/0 | 70/0 | |
| Comp. 3 | PE | 80+/5 | 0/0 | 70+/2 | 10 |
| | N | 80+/0 | 0/0 | 50+/0 | |

What is claimed is:

1. A water- and oil-repellent composition, which comprises:

(a) a water- and oil-repellent which is a homopolymer of an acrylate or methacrylate having a fluoroalkyl group possessing 4 to 21 carbon atoms or a copolymer thereof with a monomer which has no fluoroalkyl group; and (b) a glycerol compound selected from the group consisting of glycerol, an ester derivative of glycerol prepared by esterifying a hydroxyl group at the α-position with a monoalkane acid having 1 to 6 carbon atoms, an ether derivative of glycerol prepared by substituting a hydrogen of a hydroxyl group at the α-position with an alkyl group having 1 to 6 carbon atoms, and polyglycerol having a melting point of lower than 70° C.

2. The water- and oil-repellent composition according to claim 1, wherein the composition contains the glycerol compound in an amount of 0.05 to 7 parts by weight per one part by weight of the water- and oil-repellent.

3. The water- and oil-repellent composition according to claim 1, wherein the glycerol compound is selected from:

glycerol,
glycerol α-monoacetate,
glycerol α-monoformate,
glycerol α-mono-n-hexanoate,
glycerol α-monomethyl ether,
glycerol α-monoethyl ether, and
glycerol α-monoisopropyl ether.

4. The water- and oil-repellent composition according to claim 1, wherein:

the water- and oil-repellent is a homo- or copolymer comprising a fluoroalkyl group represented by one of the formulas:

$R_f(CH_2)_mOCOCR^1{=}CH_2$, $R_fSO_2NR_2(CH_2)_mOCOCR^1{=}CH_2$, and $CF(CF_3)(CClF_2)(CF_2)_7CONHCOOCH{=}CH_2$ wherein $R_f$ is a perfluoroalkyl group having 4 to 21 carbon atoms, $R^1$ is hydrogen or methyl, $R^2$ is an alkyl group having 1 to 10 carbon atoms, and m is an integer of 1 to 10.

5. The water- and oil-repellent composition according to claim 1, wherein:

the water- and oil-repellent is a homo- or copolymer comprising a fluoroalkyl group selected from the group of:

$CF(CF_3)(CClF_2)(CF_2)_7CONHCOOCH{=}CH_2$,
$CF_3(CF_2)_7(CH_2)_{11}OCOCH{=}CH_2$,
$CF_3(CF_2)_4CH_2OCOC(CH_3){=}CH_2$,
$CF_3(CF_2)_6(CH_2)_2OCOC(CH_3){=}CH_2$,
$CF(CF_3)_2(CF_2)_6(CH_2)_3OCOCH{=}CH_2$,
$CF(CF_3)_2(CF_2)_{10}(CH_2)_3OCOCH{=}CH_2$,
$CF_3(CF_2)_7SO_2N(C_3H_7)(CH_2)_2OCOCH{=}CH_2$,
$CF_3(CF_2)_7SO_2N(CH_3)(CH_2)_2OCOC(CH_3){=}CH_2$,
$CF(CF_3)_2(CF_2)_6CH_2CH(OH)CH_2OCOCH{=}CH_2$,
$CF(CF_3)_2(CF_2)_6CH_2CH(OCOCH_3)OCOC(_3){=}CH_2$,
$CClF_2(CF_2)_{10}CH_2OCOC(CH_3){=}CH_2$, *and*
$H(CF_2)_{10}CH_2OCOCH{=}CH_2$.

6. The water- and oil-repellent composition according to claim 4, wherein:

the water- and oil-repellent is a copolymer further comprising a monomer having no fluoroalkyl groups which is selected from:

ethylene, vinyl acetate, vinyl chloride, vinylidene chloride, acrylonitrile, styrene, α-methylstyrene, p-methylstyrene, acrylic acid and alkyl esters thereof, methacrylic acid and alkyl esters thereof, acrylamide, diacetone methacrylamide, vinyl alkyl ether, vinyl alkyl ketone, butadiene, isoprene, chloroprene, glycidyl acrylate, and maleic anhydride.

7. In a process of treating a fabric to impart water- and oil-repellency thereto, the improvement comprising:

applying to said fabric the water- and oil-repellent composition according to claim 1.

8. In a process of treating a fabric to impart water- and oil-repellency thereto, the improvement comprising:

applying to said fabric the water- and oil-repellent composition according to claim 4.

* * * * *